US007156620B2

(12) United States Patent
Papple

(10) Patent No.: US 7,156,620 B2
(45) Date of Patent: Jan. 2, 2007

(54) INTERNALLY COOLED GAS TURBINE AIRFOIL AND METHOD

(75) Inventor: Michael Leslie Clyde Papple, Ile des Soeurs (CA)

(73) Assignee: Pratt & Whitney Canada Corp., Longueuil (CA)

( * ) Notice: Subject to any disclaimer, the term of this patent is extended or adjusted under 35 U.S.C. 154(b) by 87 days.

(21) Appl. No.: 11/016,833

(22) Filed: Dec. 21, 2004

(65) Prior Publication Data

US 2006/0133936 A1 Jun. 22, 2006

(51) Int. Cl.
*B63H 1/14* (2006.01)

(52) U.S. Cl. ..... 416/96 R; 415/115; 415/116

(58) Field of Classification Search ..... 416/96 R, 416/96 A, 97 R, 97 A; 415/115, 116
See application file for complete search history.

(56) References Cited

U.S. PATENT DOCUMENTS 4,474,532 A 10/1984 Pazder et al.
4,775,296 A 10/1988 Schwarzmann et al.
5,232,343 A 8/1993 Butts
5,356,265 A * 10/1994 Kercher ..... 416/97 R
5,472,316 A 12/1995 Taslim et al.
5,538,394 A 7/1996 Inomata et al.
5,577,884 A 11/1996 Mari
5,695,320 A 12/1997 Kercher
5,700,132 A 12/1997 Lampes et al.
5,720,431 A 2/1998 Sellers et al.
5,975,851 A 11/1999 Liang
6,132,169 A 10/2000 Manning et al.
6,139,269 A 10/2000 Liang
6,174,134 B1 * 1/2001 Lee et al. ..... 416/97 R
6,234,754 B1 * 5/2001 Zelesky et al. ..... 416/97 R
6,273,682 B1 * 8/2001 Lee ..... 416/97 R
6,331,098 B1 12/2001 Lee
6,428,273 B1 8/2002 Keith et al.
6,602,047 B1 8/2003 Barreto et al.
6,607,355 B1 8/2003 Cunha et al.
6,607,356 B1 8/2003 Manning et al.
2003/0133795 A1 7/2003 Manning et al.
2004/0076519 A1 4/2004 Halfmann et al.

* cited by examiner

*Primary Examiner*—Hoang Nguyen
(74) *Attorney, Agent, or Firm*—Ogilvy Renault LLP

(57) ABSTRACT

An internally cooled airfoil for a gas turbine engine, wherein a plurality of elongated cooling fins are provided inside the concave sidewall.

18 Claims, 4 Drawing Sheets

INTERNALLY COOLED GAS TURBINE AIRFOIL AND METHOD

TECHNICAL FIELD

The field of the invention generally relates to internally cooled airfoils within gas turbine engines.

BACKGROUND OF THE ART

While many features have been provided in the past to maximize the heat transfer between cooling air and the airfoil, the design of gas turbine airfoils is nevertheless the subject of continuous improvements so as to further increase cooling efficiency without significantly increasing pressure losses inside the airfoil. An example of such area is the concave or pressure side of an airfoil, near the trailing edge. For instance, U.S. Pat. Nos. 6,174,134 and 6,607,356 disclose various structures intended to introduce turbulence in this region to enhance cooling efficiency, albeit at the price of an added pressure drop. Despite these past efforts, there is still a need to improve the cooling efficiency in some areas of airfoils.

SUMMARY OF THE INVENTION

In one aspect, the present invention provides an internally cooled airfoil for a gas turbine engine, the airfoil having at least one internal cooling passageway generally positioned between opposite concave and convex sidewalls, and a trailing edge outlet, the airfoil comprising: a crossover located in the passageway and being adjacent to the trailing edge outlet, the crossover comprising a plurality of crossover holes; and a plurality of elongated cooling fins provided inside the concave sidewall between the crossover and the trailing edge outlet.

In a second aspect, the present invention provides an airfoil for use in a gas turbine engine, the airfoil comprising a convex side, a concave side and a trailing edge at a rearmost portion of the airfoil, the airfoil having at least one internal cooling passageway, the airfoil comprising a plurality of internal cooling fins located inside the passageway and extending from the concave side upstream the trailing edge.

In a further aspect, the present invention provides a method of enhancing the cooling an airfoil of a gas turbine engine, the airfoil comprising at least one internal cooling passageway generally positioned between a concave sidewall and a convex sidewall, and a trailing edge outlet, the method comprising: providing a crossover located in the passageway and adjacent to the trailing edge outlet, the crossover comprising a plurality of crossover holes; providing a plurality of elongated cooling fins inside the concave sidewall between the crossover and the trailing edge outlet; and circulating an airflow inside the passageway, the airflow running through the crossover holes and then over the fins before exiting at the trailing edge outlet.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
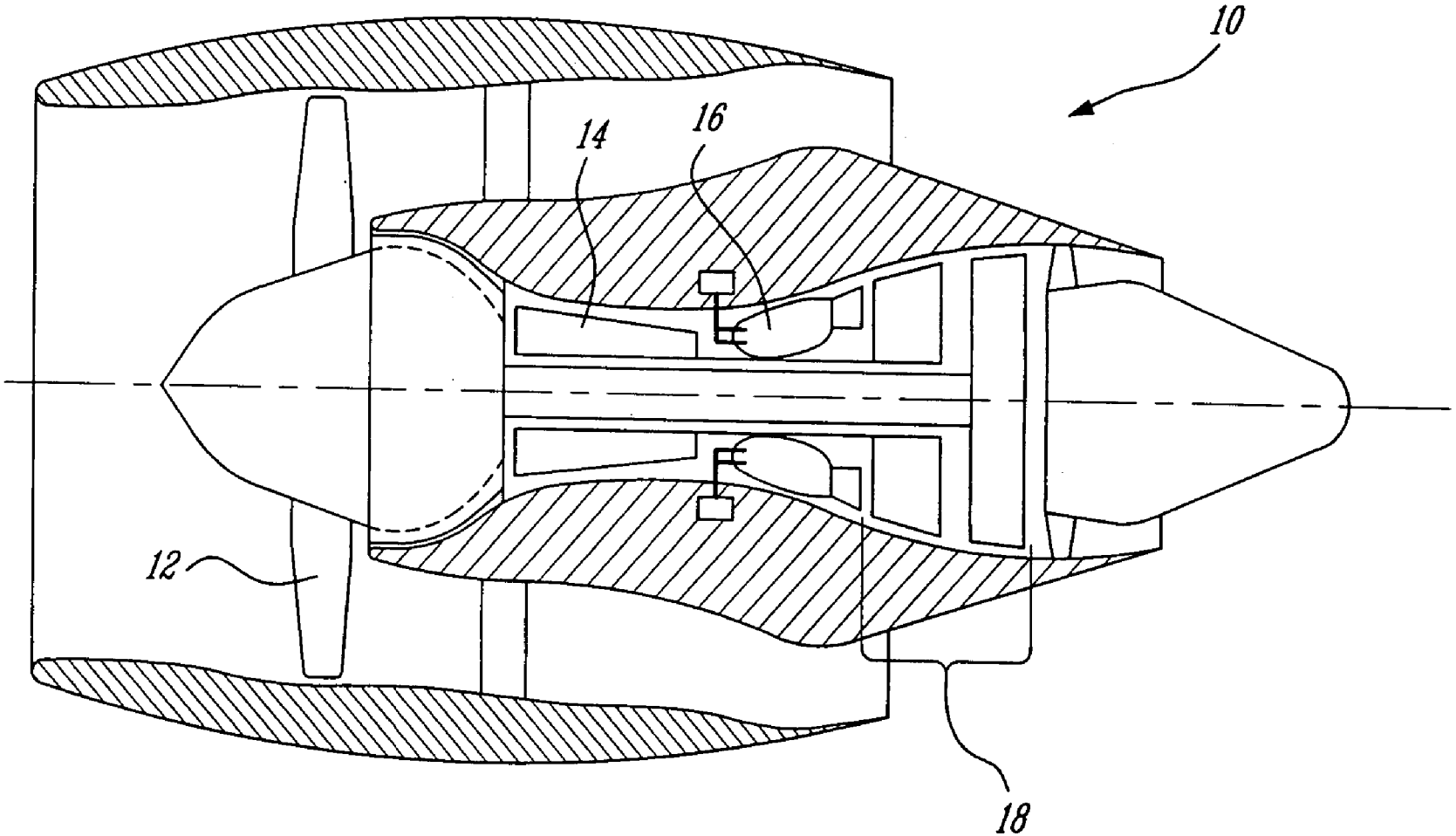
FIG. 1 schematically shows a generic gas turbine engine to illustrate an example of a general environment in which the invention can be used.

FIG. 1 illustrates an example of a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. This figure illustrates an example of the environment in which the present invention can be used.

Figure 2:
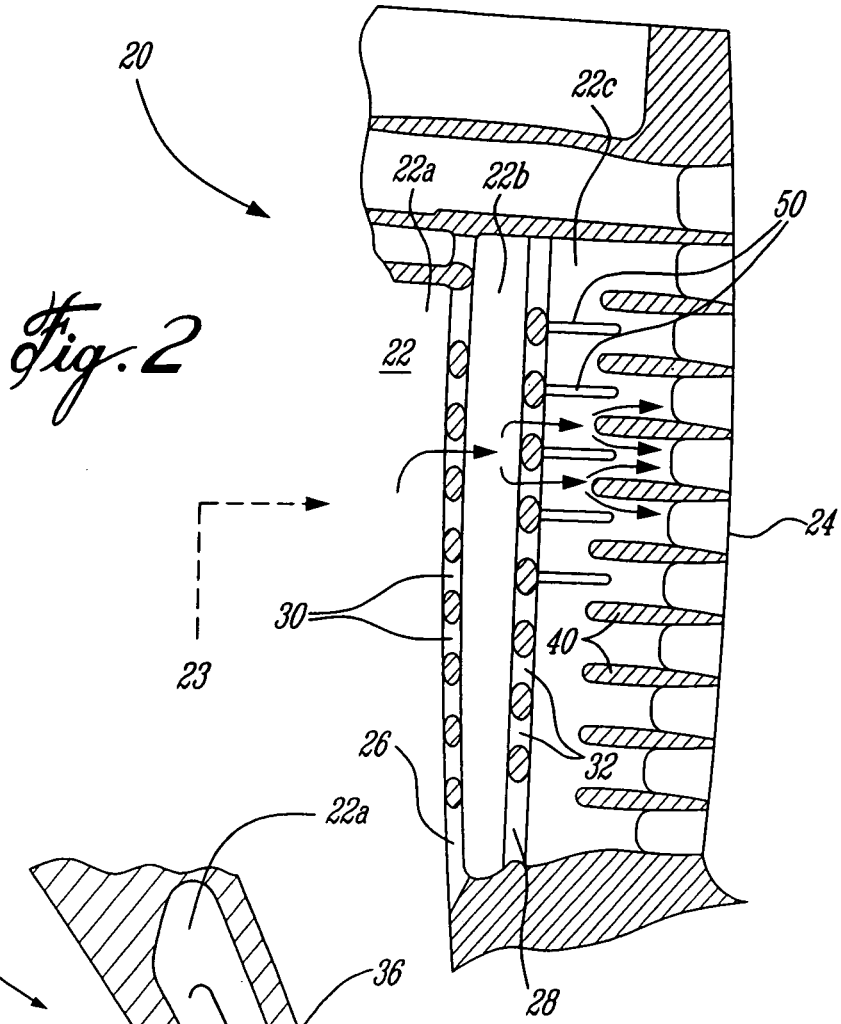
FIG. 2 is a partially cutaway view of an airfoil in accordance with one possible embodiment of the present invention.

FIG. 2 shows a cross section of the rear portion of an airfoil 20 in accordance with one possible embodiment of the present invention. This airfoil 20 comprises one or more internal cooling passageways, which will be hereafter generally referred to as the passageway 22. Air is supplied using one or more inlets 23 which generally communicate with openings (not shown) located under the airfoil 20. Some of the cooling air usually exits the airfoil 20 from the passageway 22 through a network of small holes provided at various locations in the airfoil's sidewalls. Some of the cooling air is also sent towards the outlet located at the trailing edge 24 of the airfoil 20.

Figure 3:
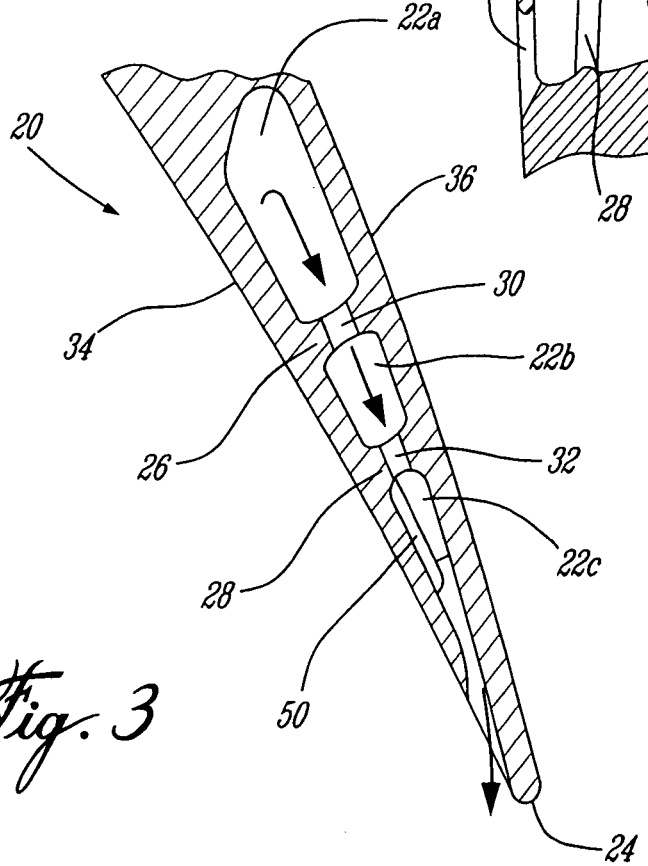
FIG. 3 is a cross-sectional view taken along line II—II FIG. 2.

Passageway 22 has at least three legs 22*a*, 22*b*, and 22*c*, respectively, which are divided by at least two perforated lands or crossovers 26 and 28, respectively. Before cooling air passing through legs 22*a* and 22*b* may reach the leg 22*c* which communicates with the trailing edge 24, the cooling air goes through at least one of preferably two crossovers 26, 28 set across the airflow path. Crossover 28, and preferably each of crossovers 26, 28, have a plurality of holes 30, 32 respectively. As best shown in FIG. 3, the crossovers 26, 28 extend from a concave sidewall 34 to a convex sidewall 36 of the airfoil 20. As also shown in the figures, lands 40 are preferably provided upstream of the trailing edge 24, and are preferably aligned with the holes 32 in the crossover 28.

The airfoil 20 also includes a plurality of elongated cooling fins 50 extending on the concave sidewall 34 between the crossover 28 and the trailing edge 24. These fins 50 have a length greater than their width.

FIGS. 2 and 3 show that preferably, at least some of the fins 50, more preferably all of them, are in aligned with and in registry with locations on the crossover 28 between the crossover holes 32. The fins 50, or at least some of the fins 50, are preferably generally parallel to each other, and are straight and are generally aligned with the direction of the cooling air flow. Also, at least some of the fins 50 are preferably having their foremost end, with reference to the cooling air flow, in contact with the crossover 28.

Figure 4:
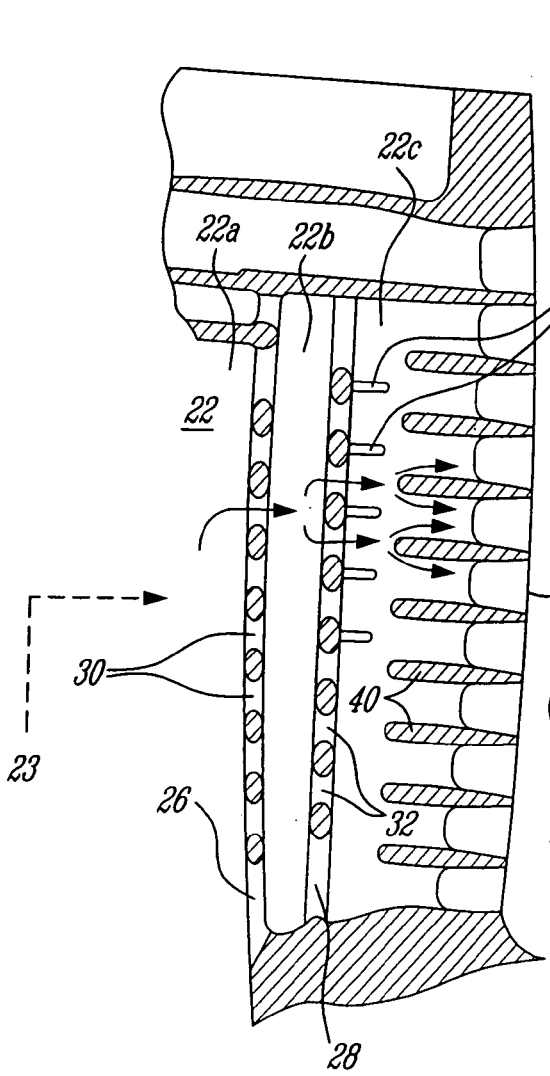
FIG. 4 is a view similar to FIG. 2, showing an airfoil in accordance with another possible embodiment of the present invention.

The fins 50 in FIGS. 2 and 3 extend to a location intermediate adjacent lands 40, such that fins 50 and lands 40 interlace somewhat. FIG. 4 shows another alternative embodiment. In this embodiment, at least some of the fins 50 have a rearmost end positioned before the lands 40.

Figure 5:
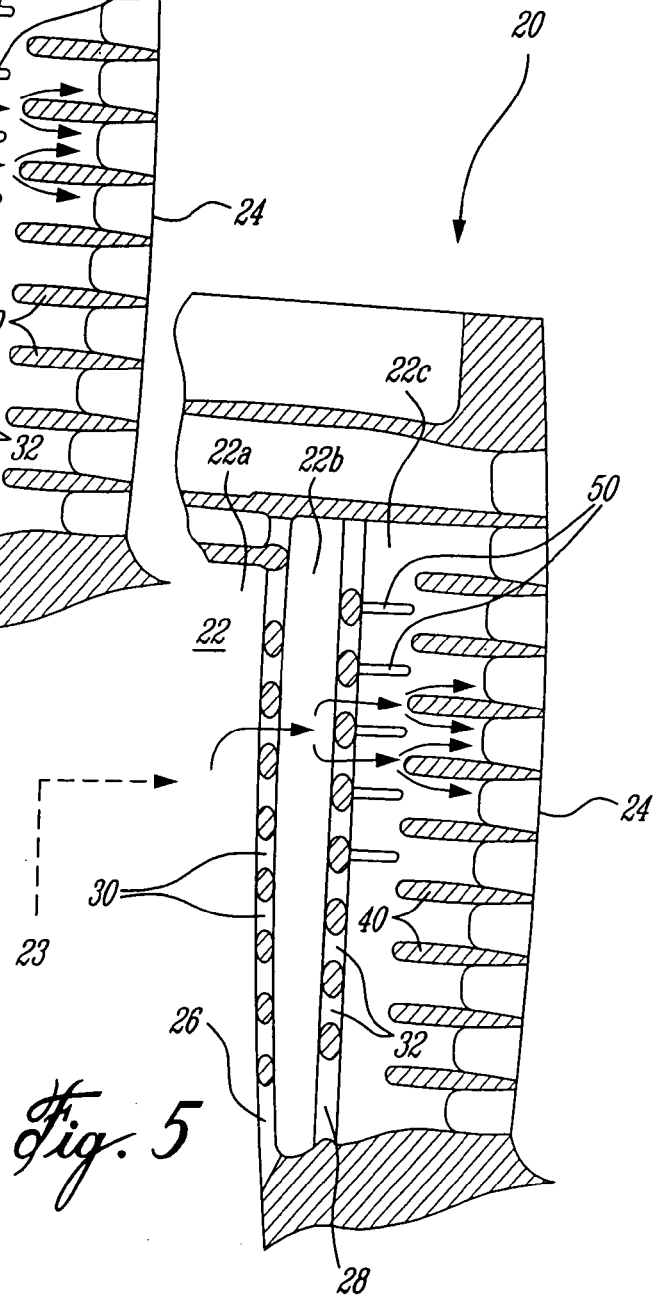
FIG. 5 is a view similar to FIG. 2, showing an airfoil in accordance with another possible embodiment of the present invention.
Figure 6:
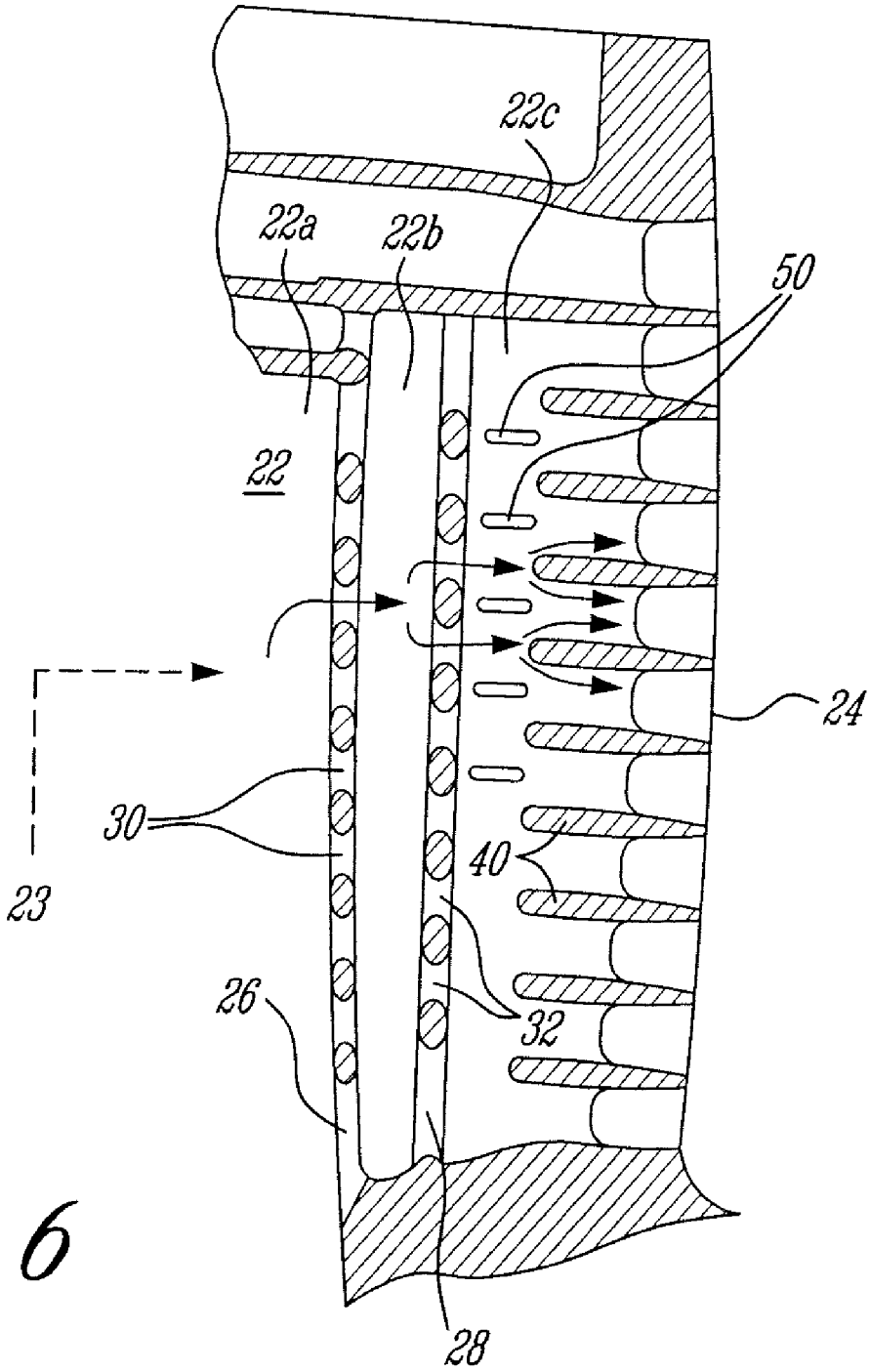
FIG. 6 is a view similar to FIG. 2, showing an airfoil in accordance with another possible embodiment of the present invention.

FIG. 5 shows another alternate embodiment, in which at least some of the fins 50 have a rearmost end substantially aligned with a foremost end of at least some of the lands 40. FIG. 6 shows another alternate embodiment, in which the fins have a foremost end spaced apart from the crossover.

As can be appreciated, the fins 50, provided inside the concave sidewall 34 between the crossover 28 and the outlet at the trailing edge 24, enhance the cooling of the airfoil 20 of a gas turbine engine 10. Hence, the concave sidewall 34 remains relatively cooler without the need for increasing the amount of air.

Unlike the prior art, the present invention offers cooling advantages without significantly increasing the pressure drop in the cooling airflow path. Consequently, lower pressure bleed air is required to drive the cooling system, which is less thermodynamically "expensive" to the overall gas turbine efficiency.

The above description is meant to be exemplary only, and one skilled in the art will recognize that changes may be made to the embodiments described without department from the scope of the invention disclosed. For example, all fins are not necessarily parallel to each other, or linearly configured, although alignment with the flow direction is preferred. Holes in the crossovers need not necessarily be staggered. The fins can be used in conjunction with other features or devices to increase heat transfer inside an airfoil. The use of the fins is not limited to the turbine airfoils illustrated in the figures, and the invention may also be employed with turbine vanes, and compressor vane and blades as well. Still other modifications which fall within the scope of the present invention will be apparent to those skilled in the art, in light of a review of this disclosure, and such modifications are intended to fall within the appended claims.

What is claimed is:

1. An internally cooled airfoil for a gas turbine engine, the airfoil having at least one internal cooling passageway generally positioned between opposite concave and convex sidewalls, and a trailing edge outlet, the airfoil comprising:

a crossover located in the passageway and being adjacent to the trailing edge outlet, the crossover comprising a plurality of crossover holes; and a plurality of elongated cooling fins provided inside the concave sidewall between the crossover and the trailing edge outlet, at least some of the fins being parallel to each other and generally parallel to the cooling air path.

2. The airfoil as defined in claim 1, wherein at least some of the fins are in registry with locations on the crossover between crossover holes.

3. The airfoil as defined in claim 2, wherein at least some of the fins are straight.

4. The airfoil as defined in claim 1, wherein with reference to the cooling air path, at least some of the fins have a foremost end in contact with the crossover.

5. The airfoil as defined in claim 1, wherein at least some of the fins have a foremost end spaced apart from the crossover.

6. The airfoil as defined in claim 1, wherein spaced-apart lands are located between the crossover and the trailing edge outlet, at least some of the fins being out of alignment with the lands.

7. The airfoil as defined in claim 6, wherein at least some of the fins have a rearmost end positioned before the lands.

8. The airfoil as defined in claim 6, wherein at least some of the fins have a rearmost end substantially aligned with a foremost end of at least some of the lands.

9. The airfoil as defined in claim 6, wherein at least some of the fins have a rearmost end located between at least some of the lands.

10. An airfoil for use in a gas turbine engine, the airfoil comprising a convex side, a concave side and a trailing edge at a rearmost portion of the airfoil, the airfoil having at least one internal cooling passageway, the airfoil comprising a plurality of internal cooling fins located inside the passageway and extending from the concave side upstream the trailing edge, at least some of the fins being parallel to each other and generally parallel to a cooling air path.

11. The airfoil as defined in claim 10, wherein at least some of the fins are in registry with locations on the crossover between crossover holes.

12. The airfoil as defined in claim 11, wherein at least some of the fins are straight.

13. The airfoil as defined in claim 10, wherein with reference to a cooling air path, at least some of the fins have a foremost end in contact with a crossover.

14. The airfoil as defined in claim 10, wherein spaced-apart lands are located between a crossover and the trailing edge, at least some of the fins being out of alignment with the lands.

15. The airfoil as defined in claim 14, wherein at least some of the fins have a rearmost end positioned before the lands.

16. The airfoil as defined in claim 14, wherein at least some of the fins have a rearmost end substantially aligned with a foremost end of at least some of the lands.

17. The airfoil as defined in claim 14, wherein at least some of the fins have a rearmost end located between at least some of the lands.

18. A method of enhancing the cooling an airfoil of a gas turbine engine, the airfoil comprising at least one internal cooling passageway generally positioned between a concave sidewall and a convex sidewall, and a trailing edge outlet, the method comprising:

providing a crossover located in the passageway and adjacent to the trailing edge outlet, the crossover comprising a plurality of crossover holes;

providing a plurality of elongated cooling fins inside the concave sidewall between the crossover and the trailing edge outlet, at least some of the fins being substantially parallel to a cooling air path; and circulating an airflow inside the passageway, the airflow running through the crossover holes and then over the fins before exiting at the trailing edge outlet.

* * * * *